United States Patent [19]

Skinner

[11] Patent Number: 4,526,283

[45] Date of Patent: Jul. 2, 1985

[54] PACKAGE CLOSURE

[76] Inventor: Robert A. Skinner, 1544 Thistledown, Apt. 2D, Okemos, Mich. 48864

[21] Appl. No.: 524,879

[22] Filed: Aug. 22, 1983

[51] Int. Cl.[3] ..... B65D 41/34

[52] U.S. Cl. ..... 215/256; 215/211; 215/251; 215/254

[58] Field of Search ..... 215/256, 211, 251, 254, 215/356; 220/270, 276

[56] References Cited

U.S. PATENT DOCUMENTS

| | | | |
|---|---|---|---|
| 389,954 | 9/1888 | Cheswright . | |
| 1,680,763 | 8/1928 | Carvalho . | |
| 2,894,654 | 7/1959 | Lohrer . | |
| 3,873,018 | 3/1975 | Donnay | 229/51 TS |
| 4,071,156 | 1/1978 | Lowe | 215/224 |
| 4,171,749 | 10/1979 | Obrist et al. | 215/256 |
| 4,307,821 | 12/1981 | McIntosh | 215/256 |
| 4,342,400 | 8/1982 | Llera | 215/256 |
| 4,387,818 | 6/1983 | Conti | 215/256 |

*Primary Examiner*—George T. Hall

*Attorney, Agent, or Firm*—Gifford, VanOphem, Sheridan, Sprinkle & Nabozny

[57] ABSTRACT

A package closure includes a stopper adapted to be sealingly engageable with the opening of the package. The closure also includes a frangible member adapted to simultaneously seal the opening and carry the stopper in a disengaged position relative to the opening. Preferably, the stopper is engageable with the package opening in a child-proof manner. Breaking of the frangible member permits the child-proof package to be initially opened without requiring the package user to struggle with the child-proof stopper. The package contents may then be transferred to a package not having child-proof sealing means. Easy access to the contents of the package by the elderly or handicapped is thereby promoted.

15 Claims, 10 Drawing Figures

PACKAGE CLOSURE

BACKGROUND OF THE INVENTION

I. Field of the Invention

The present invention is directed to package closures, and more particularly, to package closures which include tamper-indicating means, yet are easy to initially open despite being of a child-proof nature.

II. Description of the Prior Art

Tamper-indicating means for closing or sealing a package have long been known. Typical of these closures is the bottle cap or stopper having a frangible member on their bottom edge. When the cap or stopper is sealingly engaged with the bottle, the frangible member engages a bead on the bottleneck. In order to remove the cap from the bottle, the frangible member is broken or removed and the cap or stopper is operated normally. Alternatively, the frangible member can extend around some portion of both the cap and the bottleneck, and the member is broken or removed upon the opening of the bottle.

Frangible or removable tear strips have been employed on child resistant container-closure assemblies as well. Although the construction of child resistant closures varies, the significant feature of each is that some force must be applied to the container closure in order to remove the closure from the container, this force being of a degree or being applied in such a way as usually cannot be applied by a child. Such closures may require the alignment of a portion of the closure with a matching portion on the container to permit a removing force to be applied to the closure. Often this type of closure comprises a lug or lugs on the closure which engage a rib on the container, which retains the closure on the container unless such alignment has occurred. Other closures include a two piece cap, one piece serving to seal the closure, and the other adapted to sit above that portion. The upper portion is freely rotatable relative to the lower portion, unless forcibly abutted against the lower portion. Upon such abutment, twisting of the upper portion will unseal the closure from the container.

The degree of force or dexterity necessary to open such child proof containers often presents a problem to the elderly. Many individuals loose strength and dexterity as they grow older, and such loss can become severe enough to prevent the individual from opening the child-resistant container. When dealing with drugs or preparations used by both the elderly and others, the individual may not have the choice of purchasing the product in a non-child resistant container. Of course, the handicapped or infirmed face a similar problem.

SUMMARY OF THE PRESENT INVENTION

The present invention overcomes these and other problems by providing a package closure which bears tamper-indicating means, yet remains easy to initially open without losing its child-resistant characteristics. The package closure is attachable to a portion of the package defining a package opening. The closure comprises a cap sealingly engageable with the opening defining portion of the package, and a tamper-indicating means which is adapted to simultaneously seal the package opening and carry the cap in a disengaged position relative to the package opening. Preferably, the closure includes means for reversibly retaining the cap on the bottle which is child-resistant. In the preferred embodiment, this retaining means comprises a T-shaped stem on the interior portion of the cap, which is engageable with a wall on the interior of the opening defining portion of the package. However, so long as the frangible member has not been broken, the cap is carried in its disengaged position relative to the opening, so that one need not struggle with the child-resistant retaining means upon the initial opening of the bottle. An individual who does not wish to use the package in a child-resistant fashion can transfer the contents of the package to another package, one without a child-resistance closure. Alternatively, if an individual wishes to use the child-resistant retaining means, one can break the frangible member and seal the bottle with the child-resistant retaining means, prior to the initial access of any child to the package. A tamper-indicating package closure is thus provided which is easy to initially open and yet can remain child-resistant thereafter, if the user so desires.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
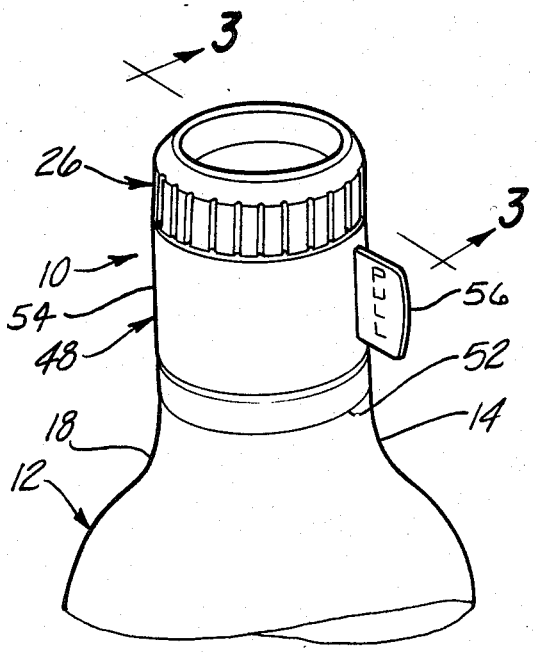
FIG. 1 is a perspective view of the preferred embodiment of the present invention.
Figure 3:
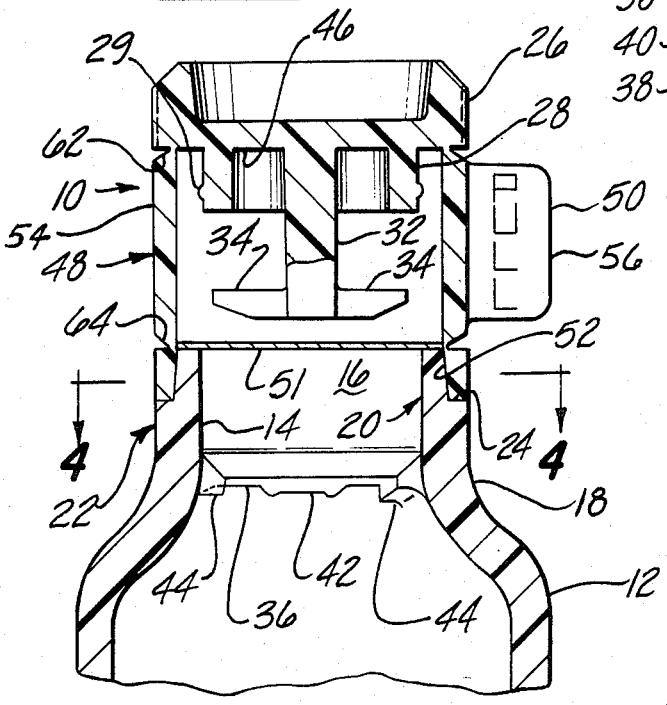
FIG. 3 is a cross-sectional view taken along line 3—3 of FIG. 1.

With reference to FIGS. 1 and 3, the package closure 10 of the present invention is thereshown in position on a package, preferably a bottle 12. The closure 10 is attached to the bottle 12 at a bottle portion 14, the bottle portion 14 defining an opening 16 in the bottle 12. Preferably, the bottle portion 14 comprises a bottle neck 18 having an inner surface 20 and an outer surface 22. The outer surface 22 of the neck 18 bears a shoulder 24, at which the closure 10 is attached to the bottle 12.

Figure 5:
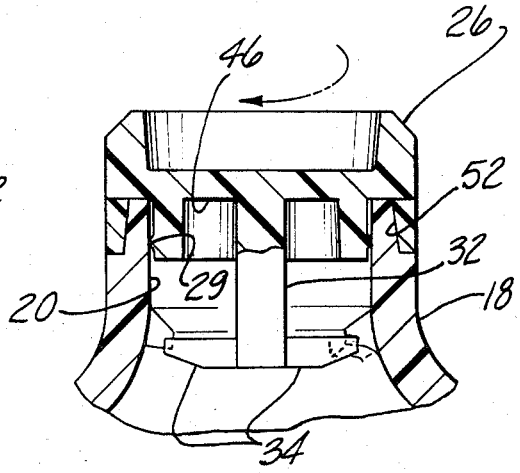
FIG. 5 is a cross-sectional view similar to FIG. 3.
Figure 8:
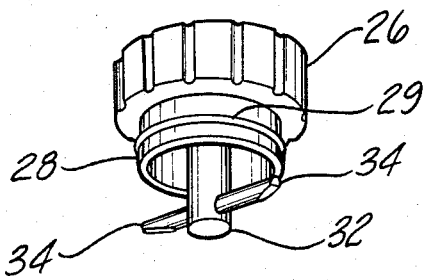
FIG. 8 is a prespective view of a portion of the preferred embodiment of the present invention.

The package closure 10 of the present invention first comprises a bottle-engageable sealing means, such as a stopper 26. The stopper 26 has a stopper portion 28 thereon which is sealingly engageable with the bottle 12 at the opening 16. Preferably, as best shown in FIGS. 5 and 8, the stopper portion 28 includes a raised bead 29 engageable with the inner surface 20 of the bottle neck 18.

Figure 4:
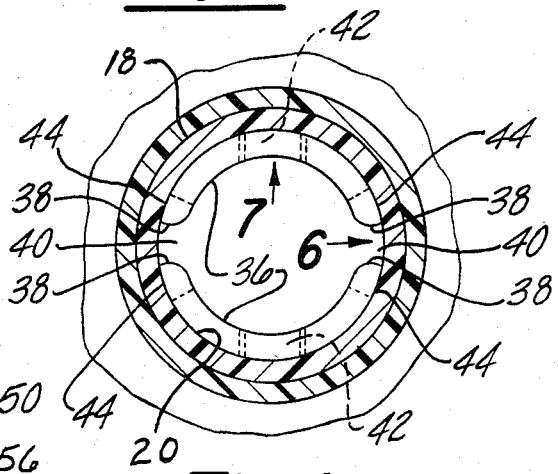
FIG. 4 is a cross-sectional view taken along line 4—4 of FIG. 3.

The stopper 26 includes a T-shaped stem portion 32 with a pair of lugs 34 disposed thereon. Each of the lugs 34 is adapted to engage one of a pair of cam surfaces 36 on the inner surface 20 of the neck 18 (FIG. 4). Each of the cams 36 comprises a pair of edges 38. The edges 38 of each of the cams 36 are disposed oppositely of one another, so as to define a gap 40 therebetween. The gap 40 is adapted for the passage therethrough of the lugs 34 of the stopper 26.

Figure 6:
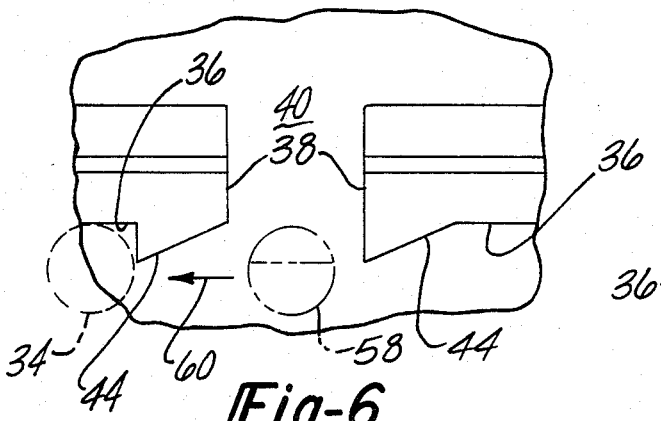
FIG. 6 is a partial elevational view taken along arrow 6 of FIG. 4.
Figure 7:
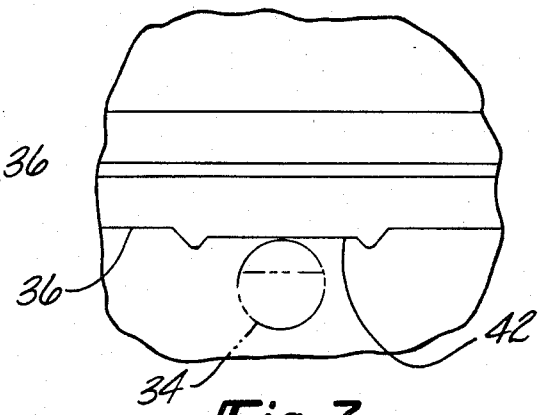
FIG. 7 is a partial elevational view taken along arrow 7 of FIG. 4.

As can best be seen in FIGS. 3, 6 and 7, each of the cams 36 also comprises a raised recess 42 for retaining the lugs 34 in a relatively locked position, and at least one ramped shoulder 44 between the recess 42 and the adjacent edge 38. The ramped shoulder or shoulders 44 are each slanted in the same circumferential direction so that, when the stopper 26 is sealingly engaged with the bottle 12, its rotation is restricted in one direction.

The stopper portion 28 thus will abut against the bottle portion 14 when the lugs 34 are engaged in the recesses 42. Preferably, the stopper 24 is constructed of a resilient material such as plastic, so that the stopper portion 28 is biased somewhat away from the rest of the stopper 26 and resiliently abuts the bottle portion 14. An annular relief cut 46, disposed about the stem 32, assists in providing this resiliency. Resistance to the removal of the stopper 26 from the bottle 12 is thereby provided.

The closure 10 also comprises a tamper-indicating means 48, preferably a frangible member 50. The frangible member 50 is attached to both the stopper 26 and the bottle 12, preferably at the shoulder 24. The frangible member 50 can seal the package itself, or it or the package can be covered with an additional tamper-indicating and/or sealing means. For example, this additional means can comprise plastic shrink-wrap disposed over the bottle opening 16, or disposed about the entire package. Preferably, however, this additional means comprises a metal foil disk 51 sealed to the end of the bottle neck 18. In either case, the tamper-indicating means 48 then comprises both the frangible member 50 and this additional means.

As shown in FIGS. 1 and 3, the tamper-indicating means 48 serves both to seal the package 12, and to carry the stopper 26 in a disengaged position, prior to the initial opening of the package. Preferably, the stopper 26 and the frangible member 50 are formed integrally, with the member 50 having a lower edge 52 attached to the bottle portion 14. In the preferred embodiment, the stopper 26, member 50 and package 12 are all constructed from plastic, and the lower edge 52 of the frangible member 50 is sonically welded to the package 12 at the shoulder 24. A tear strip 54 is formed in the frangible member 50 by a pair of continuous notches 62 and 64, disposed in the member 50 between a pull tab 56, and the stopper 26 and the lower edge 52 of the member 50, respectively. The notches 62 and 64 are radially sufficiently deep to permit relatively easy breaking therethrough.

Figure 9:
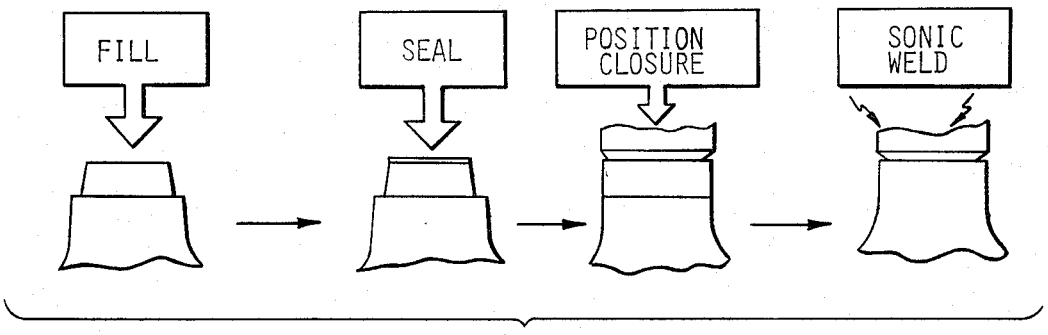
FIG. 9 is a flow diagram of the preferred embodiment of the present invention.

Assembly of the package closure of the present invention is simple, and is shown schematically in FIG. 9. First, the bottle 12 is filled with a desired material. The closure is then placed over the bottle opening 16. Preferably, this placement step comprises two steps: (a) sealing the metal foil disk 51 to the end of the bottle neck 18; and (b) positioning the remainder of the closure 10 over the opening 16 so that the lower edge 52 of the frangible member 50 abuts the shoulder 24 on the bottle neck 18. The lower edge 52 of the member 50 is then attached to the bottle 12. Preferably, the member 50 and the bottle 12 are both constructed of plastic, so that this attachment occurs by sonically welding the lower edge 52 of the member 50 to the bottle 12.

The package closure of the present invention is straightforward in use. The tamper-indicating means 48 is breached in a fashion so as to permit separation of the stopper 26 from the bottle portion 14. In the preferred embodiment, the tab 56 is pulled, and the tear strip 54 is broken free at the notches 62 and 64 and removed from the bottle 12 and the stopper 26. The stopper 26 is thus easily freed from the bottle 12, since it is not sealingly engaged therewith. The lower edge 52 of the frangible member 50 remains attached to the bottle neck 18.

Figure 2:
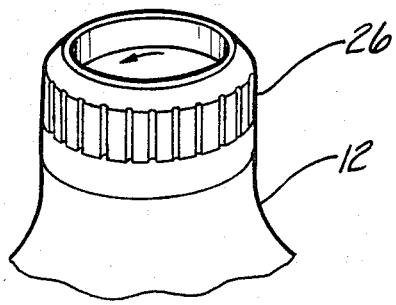
FIG. 2 is a perspective view of the preferred embodiment of the present invention.

The removal of the tear strip 54 is relatively easy, even for the elderly or the infirmed. The package 10 is thereby opened without the user having to struggle with the childproof nature of the bottle closure. When initially opened in this fashion, the package can be made childproof by first inserting the stopper stem 32 into the package opening 16, passing the lugs 34 through the gaps 40 (Position 58 in FIG. 6). The stopper 26 is then twisted in the direction of arrow 60, past the ramp 44, until the lugs 34 engage the recesses 42 in the cams 36 (FIG. 7). The stopper 26 is thus retained on the bottle 12, as shown in FIG. 2, in a child-proof manner. Alternatively, if it is desired to bypass the child-proof feature of the bottle, the contents of the package can be transferred to another container which does not have a child-proof closure.

Figure 10:
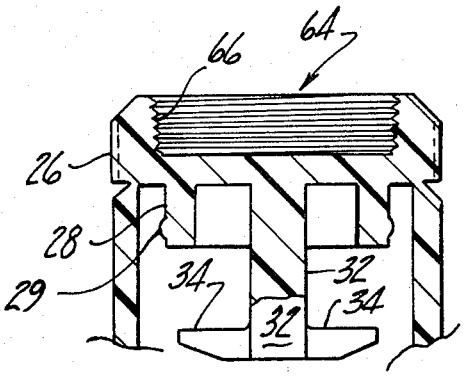
FIG. 10 is a cross-sectional view of another preferred embodiment of the present invention.

In an alternative preferred embodiment of the present invention, the stopper 26 can include a second reversible package engaging means 64 (FIG. 10), disposed opposite the stem 32. Preferably, this second means is not child-resistant. For example, the stopper could include a threaded recess 66 opposite the stem which defines a screw cap, which is threadably engageable with the outer surface 22 of the bottleneck 18. The need for a second package is thus obviated, yet the user can still avoid dealing with the child-resistant feature of the package.

In another preferred embodiment of the present invention, the cam can be disposed on the stopper, instead of on the inner surface of the bottleneck, the lugs then being disposed on the interior of the bottle neck 18.

Having described my invention, however, many modifications thereto will become apparent to those skilled in the art to which it pertains without deviation from the spirit of the invention as defined by the scope of the appended claims.

I claim:

1. A container closure comprising:

a stopper member having stopper means and means engageable with said container for fastening said stopper means to said container; and frangible means for attaching said stopper member to said container in a position whereat said fastening means is not engaged with said container, said frangible attaching means comprising a detachable skirt extending between said container and said stopper member, said skirt being radially outwardly spaced from said stopper means.

2. The invention according to claim 1, wherein said container comprises an opening, wherein said closure additionally comprises a radially depending cam on said container at said opening, and wherein said fastening means comprises a radially depending portion engageable with said cam.

3. The invention according to claim 2, wherein said depending portion comprises a stem and at least one perpendicular lug on said stem.

4. The invention according to claim 1, wherein said stopper member, additionally comprises a second fastening means opposite said first fastening means, said second fastening means engaging said container in a fashion other than that of said first fastening means.

5. The invention according to claim 1, wherein said frangible means comprises a lower edge affixed to said container, from which the remainder of said frangible means can be detached upon opening of said container.

6. The invention according to claim 4, wherein said second fastening means comprises a threaded recess in said stopper means.

7. The invention according to claim 1, wherein said closure further comprises a rupturable membrane normally disposed across the opening of said container.

8. The invention according to claim 1, wherein said fastening means is adapted to be engageable with said package so as to form a child-proof container.

9. The invention according to claim 3, wherein said at least one cam comprises a split ring adapted to permit the passage of said at least one lug therethrough.

10. The invention according to claim 9, wherein each of said at least one cam comprises a recess adapted to receive one of said at least one lug therein.

11. The invention according to claim 9, wherein said at least one cam comprises a ramp surface restricting the circumferential motion of said at least one lug when said at least one lug has passed said at least one cam.

12. The invention according to claim 1, wherein said fastening means and said frangible means are of integral construction.

13. The invention according to claim 1, wherein said closure comprises a plastic material.

14. The invention according to claim 1, wherein said frangible means comprises a plastic material.

15. The invention according to claim 1, wherein said closure is sonically welded to said package.

* * * * *

UNITED STATES PATENT AND TRADEMARK OFFICE

CERTIFICATE OF CORRECTION

PATENT NO. : 4,526,283

DATED : July 2, 1985

INVENTOR(S) : Robert A. Skinner

It is certified that error appears in the above-identified patent and that said Letters Patent is hereby corrected as shown below:

Column 3, line 18 delete "24" insert --26--.

Signed and Sealed this

*Eighth* Day of *October 1985*

[SEAL]

*Attest:*

DONALD J. QUIGG

*Attesting Officer*

*Commissioner of Patents and Trademarks—Designate*